US005729797A

United States Patent [19]

Okada et al.

[11] Patent Number: 5,729,797

[45] Date of Patent: Mar. 17, 1998

[54] TONER CARTRIDGE

[75] Inventors: Mitsuharu Okada; Katsumi Okamoto, both of Osaka, Japan

[73] Assignee: Mita Industrial Co., Ltd., Osaka, Japan

[21] Appl. No.: 805,932

[22] Filed: Feb. 25, 1997

[30] Foreign Application Priority Data

Mar. 29, 1996 [JP] Japan ..... 8-076302

[51] Int. Cl.[6] ..... G03G 15/08

[52] U.S. Cl. ..... 399/120; 399/106; 399/262; 222/DIG. 1

[58] Field of Search ..... 399/119, 120, 399/106, 262; 222/DIG. 1, 541.4; 141/364, 375

[56] References Cited

U.S. PATENT DOCUMENTS

| | | | |
|---|---|---|---|
| 4,629,309 | 12/1986 | Tsukano et al. | 399/257 |
| 5,384,629 | 1/1995 | Watanabe et al. | 399/120 |
| 5,432,592 | 7/1995 | Watanabe et al. | 399/120 |
| 5,479,247 | 12/1995 | Watanabe et al. | 399/120 |
| 5,541,714 | 7/1996 | Watanabe et al. | 399/120 |
| 5,630,198 | 5/1997 | Makino | 399/120 |

FOREIGN PATENT DOCUMENTS 8-006389 1/1996 Japan .

*Primary Examiner*—Matthew S. Smith

*Attorney, Agent, or Firm*—Beveridge, DeGrandi, Weilacher & Young, LLP

[57] ABSTRACT

A toner cartridge includes an inner tubular container having a toner discharge opening and accommodating a toner; an outer tubular case having a toner passage opening corresponding to the toner discharge opening, and being fitted around the inner tubular container relatively rotatably; and a seal member having a sealing portion for covering the toner discharge opening, the sealing portion being strippably bonded to the outer peripheral surface of the inner tubular container, and an action portion formed as a continuum of the sealing portion and having a front end part secured to the outer tubular case. The sealing portion of the seal member has a longitudinal bond portion and a peripheral bond portion defined along the surroundings of the toner discharge opening, and a cut groove provided inwardly of the peripheral bond portion at the peel start side end part thereof.

2 Claims, 4 Drawing Sheets

TONER CARTRIDGE

FIELD OF THE INVENTION

This invention relates to a toner cartridge applied to a developing device in an image forming machine, such as an electrostatic copying apparatus or a laser printer.

DESCRIPTION OF THE PRIOR ART

As is well known, an image forming machine, such as an electrostatic copying apparatus or a laser printer, forms a latent electrostatic image on an electrostatic photoconductor, and develops this image to a toner image by a developing device. In a developing device for applying a toner to a latent electrostatic image to develop it to a toner image, a toner cartridge system is generally used to supply the toner. The toner cartridge system involves mounting a toner cartridge, accommodating a toner, on a toner cartridge acceptance portion of the developing device, and unsealing its toner discharge opening to supply the toner. Such a toner cartridge is disclosed, for example, in Japanese Laid-Open Utility Model Publication No. 14769/85. This publication discloses a toner cartridge comprising an inner tubular container having a longitudinally extending toner discharge opening and accommodating a toner; an outer tubular case having a toner passage opening corresponding to the toner discharge opening provided in the inner tubular container, and being fitted in the inner tubular container so as to be capable of relative rotation; and a seal member having a sealing portion for covering the toner discharge opening formed in the inner tubular container, and an action portion formed as a continuum of the sealing portion and having a front end part secured to the outer tubular case; wherein the inner tubular container and the outer tubular case are rotated relative to each other, whereby the seal member is peeled off at least partially to unseal the toner discharge opening, so that the toner is dropped through the unsealed toner discharge opening and the toner passage opening provided in the outer tubular case. The sealing portion of the seal member in this toner cartridge is strippably bonded to a longitudinal bond portion and a peripheral bond portion that are defined in correspondence with the surroundings of the toner discharge opening formed in the inner tubular member.

In the above-described toner cartridge, in peeling the seal member off, the inner tubular container and the outer tubular case are relatively rotated, thereby peeling the longitudinal bond portion on the peeled side that is defined around the toner discharge opening. Then, they are relatively rotated through about 180 degrees to peel the peripheral opposite bond portions. Thus, even after the longitudinal bond portion on the peeled side is peeled off, a load for peeling the peripheral bond portions works. Therefore, a movement through more than 180 degrees is difficult to effect with a single rotating operation. This requires that the operating portion be gripped anew during the peeling procedure, and a peeling operation be performed again. As noted from this, the toner cartridge in customary use is not entirely satisfactory in terms of a peeling operation for the seal member.

The foregoing toner cartridge also poses the following problem: To peel the seal member off, the inner tubular container and the outer tubular case are relatively rotated, thereby peeling the longitudinal bond portion on the peeled side that is defined around the toner discharge opening. In order to decrease a load at the start of peeling, and make a load during peeling nearly constant, the longitudinal bond portion protrudes at the center like a mountain so that peeling will take place gradually from the center to the opposite ends. When the center of the longitudinal bond portion protrudes, however, the peel length in the peripheral direction increases by the amount of this protrusion, thus increasing the amount of relative rotation of the inner tubular container and the outer tubular case. To shorten the peripheral peel length while ensuring an open area of the toner discharge opening, the toner discharge opening is formed, with its center protruding, along the longitudinal bond portion. However, the peripheral open lengths of the opposite ends of the toner discharge opening become short, causing the disadvantage that the toner is not discharged without fail, but remains at the opposite end portions.

SUMMARY OF THE INVENTION

A first object of the present invention is to provide a toner cartridge constructed such that no peel load works after peeling the longitudinal bond portion on the peeled side in peeling off the seal member, whereby the peeling procedure for the seal member can be performed easily.

A second object of the invention is to provide a toner cartridge in which a load at the start of peeling the seal member can be decreased, a load during peeling can be made nearly constant, and the toner can be discharged reliably.

To attain the first object, the invention provides a toner cartridge comprising an inner tubular container having a longitudinally extending toner discharge opening and accommodating a toner; an outer tubular case having a toner passage opening corresponding to the toner discharge opening provided in the inner tubular container, and being fitted around the inner tubular container so as to be capable of relative rotation; and a seal member having a sealing portion for covering the toner discharge opening formed in the inner tubular container, the sealing portion being strippably bonded to the outer peripheral surface of the inner tubular container, and an action portion formed as a continuum of the sealing portion and having a front end part secured to the outer tubular case; wherein the sealing portion of the seal member has a longitudinal bond portion and a peripheral bond portion defined along the surroundings of the toner discharge opening, and a cut groove provided inwardly of the peripheral bond portion at the peel start side end part thereof.

To attain the second object, the invention provides the toner cartridge in which the sealing portion of the seal member has a longitudinal bond portion and a peripheral bond portion defined along the surroundings of the toner discharge opening, and the longitudinal bond portion on the action portion side is peeled off, beginning at the opposite ends thereof, gradually toward the center in the longitudinal direction.

BRIEF DESCRIPTION OF THE DRAWINGS

FIG. 1 is a perspective view showing a preferred embodiment of a toner cartridge constructed in accordance with the present invention, along with a developing device which it is applied to;

DETAILED DESCRIPTION OF THE PREFERRED EMBODIMENTS

Figure 1:
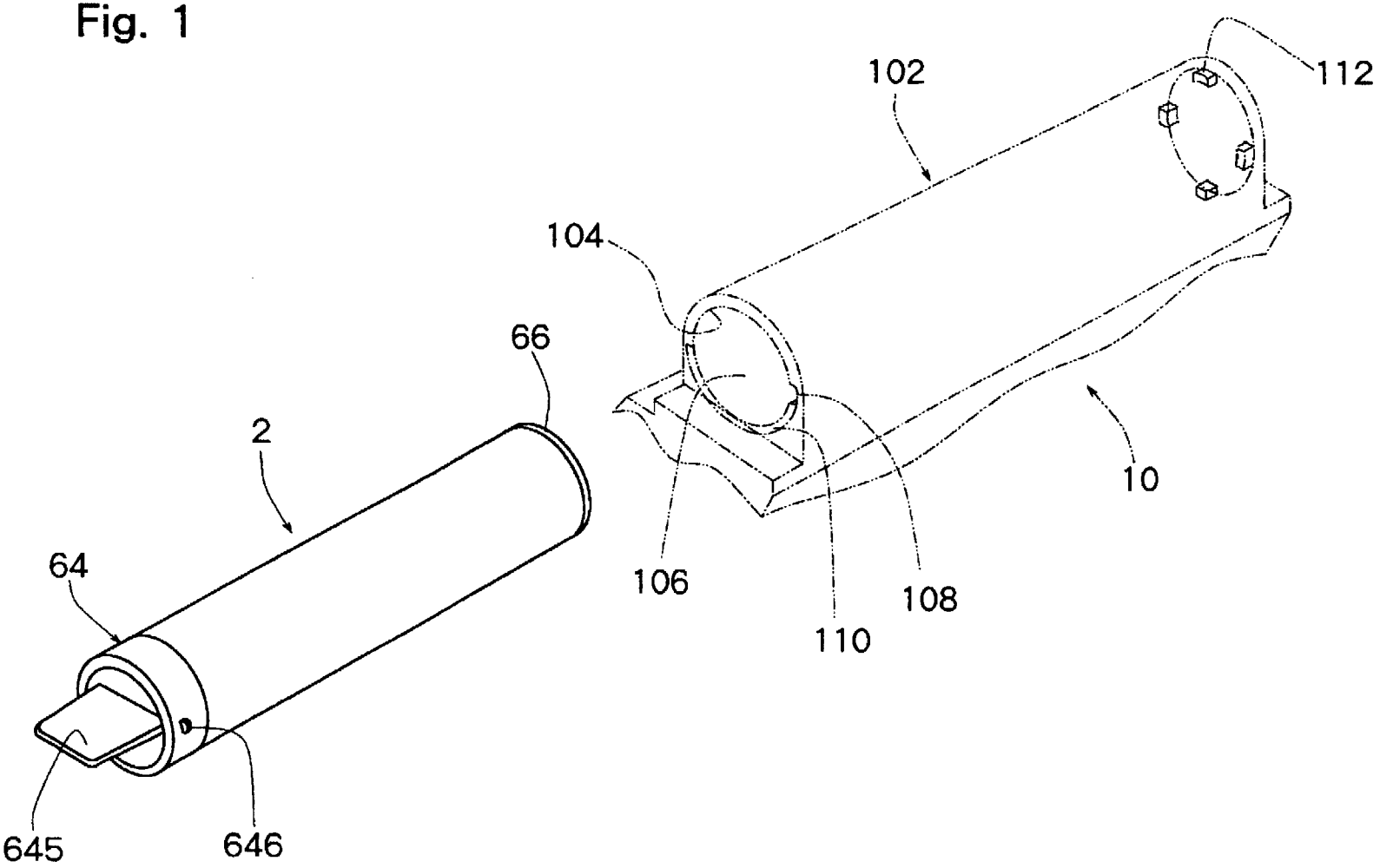

Preferred embodiments of a toner cartridge constructed in accordance with the present invention will be described in detail with reference to the accompanying drawings.

Referring to FIGS. 1 to 4, a toner cartridge indicated generally by the numeral 2 is composed of an inner tubular container 4, an outer tubular case 6, and a seal member 8.

The inner tubular container 4 constituting the toner cartridge is composed, in the illustrated embodiment, of three members, a tubular member 42, one end wall member 44 mounted on one end of the tubular member 42, and the other end wall member 46 mounted on the other end of the tubular member 42. The tubular member 42 and both end wall members 44, 46 define a toner accommodation space 40.

Figure 2:
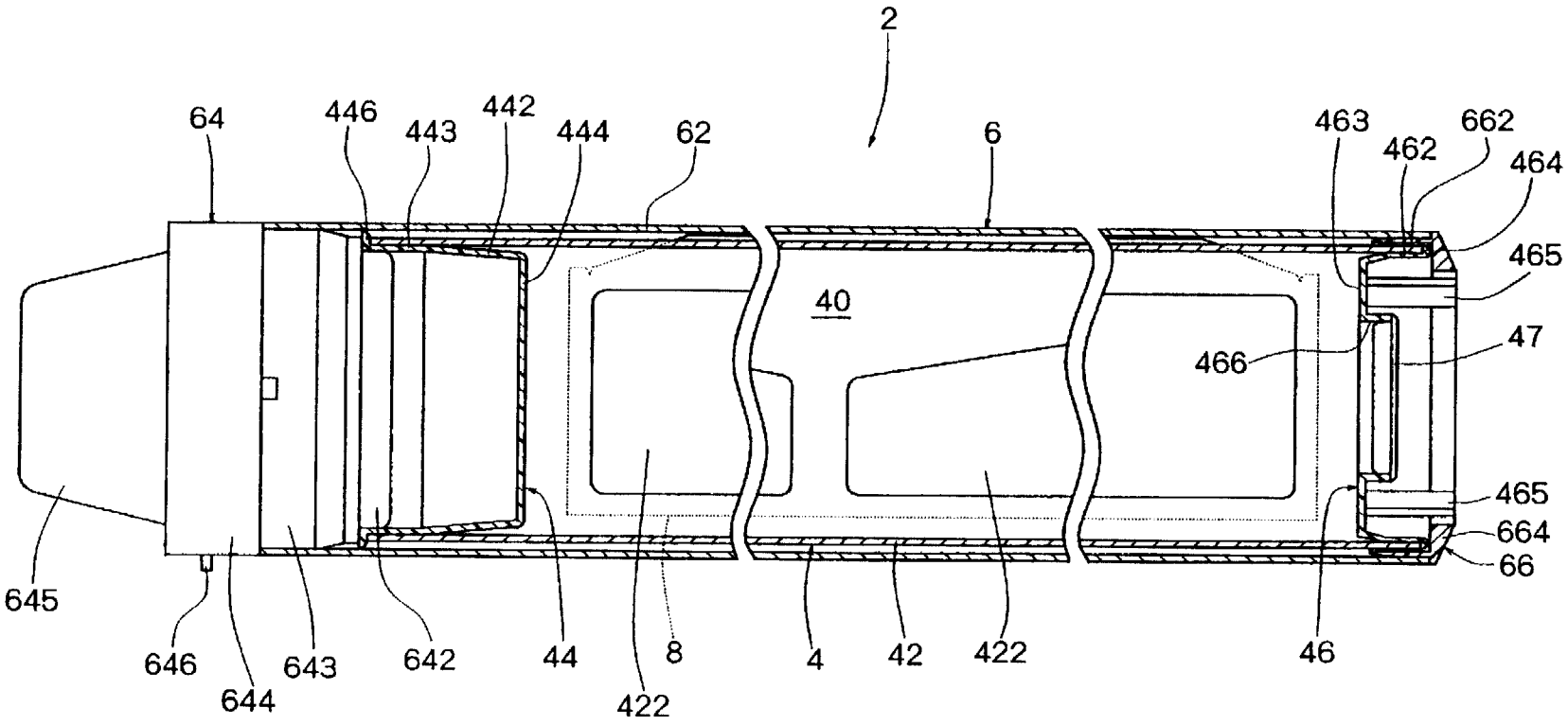
FIG. 2 is a longitudinal sectional view of the toner cartridge shown in FIG. 1.
Figure 3:
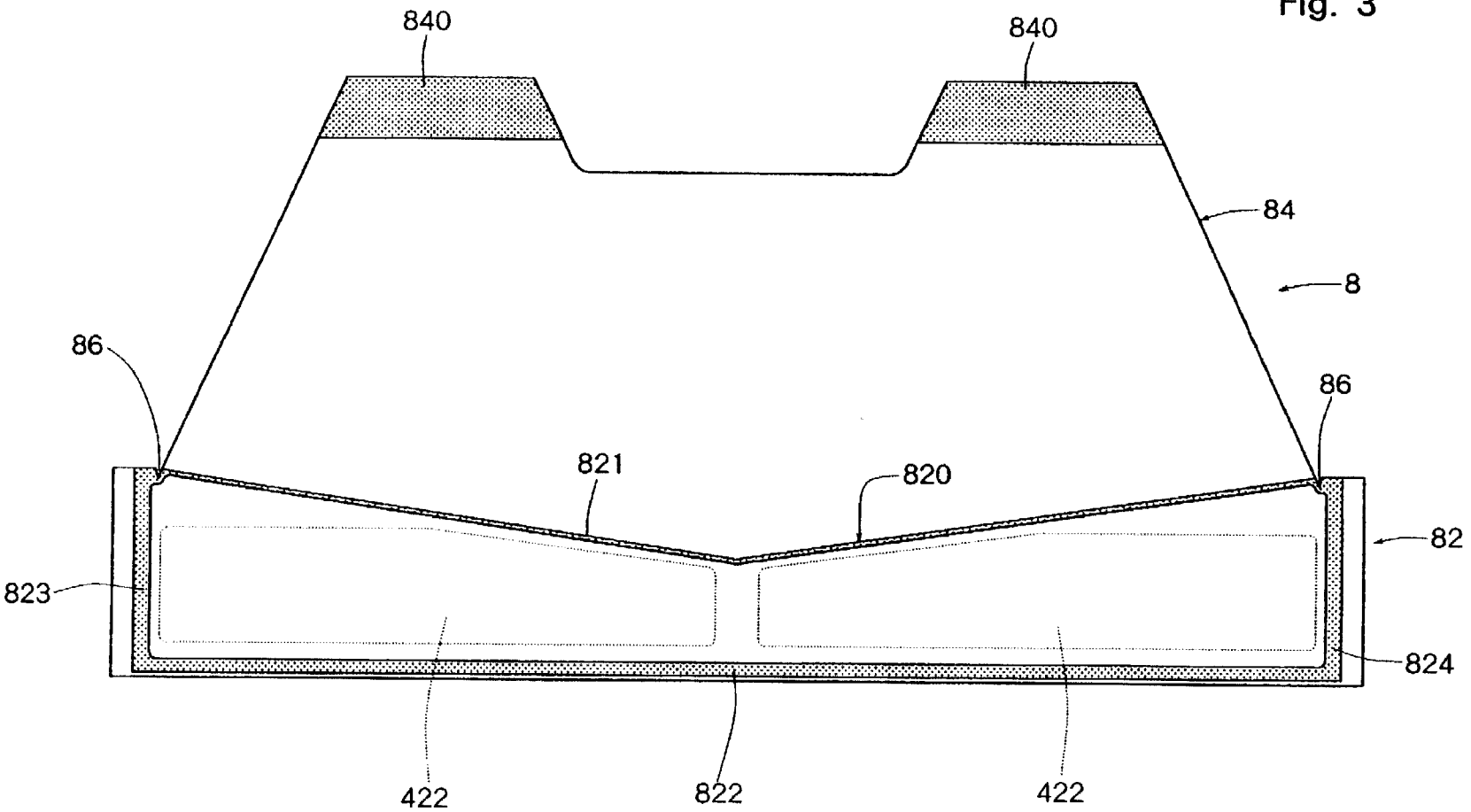
FIG. 3 is a plan view of a seal member, as a development, constituting the toner cartridge illustrated in FIG. 1 to show its relation with a toner discharge opening.

The tubular member 42 constituting the inner tubular container 4 is preferably cylindrical in shape. Such tubular member 42 may be formed of a boxboard having an aluminum foil laminated on its inner peripheral surface, and a suitable plastic film, such as a nylon film, coated on its outer peripheral surface. The tubular member 42 may be molded from a suitable plastic material. In the tubular member 42, two toner discharge openings 422, 422 extending in the longitudinal direction are formed in the illustrated embodiment. The toner discharge openings 422, 422 are positioned, in the illustrated state, at a lower portion of the tubular member 42. The toner discharge openings 422, 422 are formed such that the outer peripheral length thereof is larger than the inner peripheral length thereof, as shown in FIGS. 2 and 3.

The one end wall member 44 mounted on the one end of the tubular member 42 constituting the inner tubular container 4 is formed of a suitable plastic material to assume the shape of a cup. This one end wall member 44 is constituted by a cylindrical short tubular wall portion 442 fitted into one end portion of the tubular member 42, an end wall 444 formed at the inner end of the short tubular wall portion 442, and an annular wall portion 446 formed at the outer end of the short tubular wall portion 442 so as to extend radially outwardly. The outer diameter of a secured portion 443 formed at an outer end part of the short tubular wall portion 442 is substantially the same as the inner diameter of the tubular member 42. The outer peripheral surface of the secured portion 443 is secured to the inner peripheral surface of an end part (the left end part in FIG. 2) of the tubular member 42 using a suitable adhesive, whereby the end wall member 44 is fixed to the end part of the tubular member 42.

The other end wall member 46 mounted on the other end of the tubular member 42 constituting the inner tubular container 4 is formed of a suitable plastic material. This end wall member 46 is constituted by a cylindrical short tubular wall portion 462 fitted into the other end portion of the tubular member 42, an end wall 463 formed at the inner end of the short tubular wall portion 462, and an annular wall portion 464 formed at the outer end of the short tubular wall portion 462 so as to extend radially outwardly. The outer diameter of the outer end part of the short tubular wall portion 462 is substantially the same as the inner diameter of the tubular member 42. The outer peripheral surface of the outer end part is secured to the inner peripheral surface of the other end part (the right end part in FIG. 2) of the tubular member 42 using a suitable adhesive, whereby the end wall member 46 is fixed to the other end part of the tubular member 42. In the illustrated embodiment, the end wall 463 constituting the end wall member 46 is provided with four rotation restraining members 465 formed so as to protrude outwardly. When the toner cartridge 2 is loaded into a toner cartridge acceptance portion of a developing device to be described later, the rotation restraining members 465 function to suppress the rotation of the inner tubular container by engaging engagement members provided in the toner cartridge acceptance portion. The end wall 463 constituting the end wall member 46 is also provided with a toner fill port 466, and a stopper 47 is detachably fitted to the toner fill port 466.

The outer tubular case 6 constituting the toner cartridge is composed, in the illustrated embodiment, of a tubular member 62 which has an inner diameter larger than the outer diameter of the tubular member 42 constituting the inner tubular container 4, and which is fitted over the tubular member 42; a turning member 64 mounted on one end of the tubular member 62; and a support member 66 mounted on the other end of the tubular member 62.

The tubular member 62 constituting the outer tubular case 6 may be formed of a boxboard having a suitable plastic film, such as a nylon film, coated on its outer peripheral surface. Its length is larger than the length of the tubular member 42 constituting the inner tubular container 4. The outer tubular case 6 may be formed from a suitable plastic material. In the tubular member 62 constructed in this manner, a toner passage opening 622 extending in the longitudinal direction is formed. The toner passage opening 622 is positioned, in the state illustrated in FIG. 4, at an upper part of the tubular member 62. The toner passage opening 622 formed in the tubular member 62 may be formed either in a shape corresponding to the toner discharge openings 422,422 formed in the tubular member 42 constituting the inner tubular container 4, or in a rectangular shape. The toner passage opening 622 formed in the tubular member 62 is desirably constructed such that its longitudinal dimension and peripheral dimension are somewhat larger than those of the toner discharge openings 422, 422.

The turning member 64 constituting the outer tubular case 6 is formed of a suitable plastic material. The turning member 64 is composed of a support portion 642 fitted relatively rotatably into the end wall member 44 constituting the inner tubular container 4, a cylindrical secured portion 643 fitted into one end part of the tubular member 62 constituting the outer tubular case 6, an annular portion 644 having a larger outer diameter than the outer diameter of the tubular member 62, and a grip portion 645 formed so as to protrude from the annular portion 644. The outer diameter of the cylindrical secured portion 643 is substantially the same as the inner diameter of the tubular member 62. The outer peripheral surface of the secured portion 643 is secured to the inner peripheral surface of one end part (the left end part in FIG. 2) of the tubular member 62 using a suitable adhesive, whereby the turning member 64 is fixed to the one end part of the tubular member 62. At the outer peripheral surface of the annular portion 644, a registration projection 646 is provided.

The support member 66 constituting the outer tubular case 6 is formed of a suitable plastic material. The support member 66 is composed of a cylindrical secured portion 662 fitted into the other end part of the tubular member 62, and an annular portion 664 having a larger outer diameter than the outer diameter of the tubular member 62. The outer diameter of the cylindrical secured portion 662 is substantially the same as the inner diameter of the tubular member 62. The outer peripheral surface of the secured portion 662 is secured to the inner peripheral surface of the other end part (the right end part in FIG. 2) of the tubular member 62 using a suitable adhesive, whereby the support member 66 is fixed to the other end part of the tubular member 62.

The seal member 8 constituting the toner cartridge is formed of a suitable flexible plastic film such as a nylon film, and is constructed in the shape illustrated in FIG. 3. The seal member 8 has a sealing portion 82 for covering the two toner discharge openings 422, 422 formed in the tubular member 42 constituting the inner tubular container 4, and an action portion 84 extending from the sealing portion 82.

The sealing portion 82 that defines one end part of the seal member 8 is positioned on the outer peripheral surface of the tubular member 42 to cover the toner discharge openings 422, 422. A peripheral edge region of the sealing portion 82 that surrounds the toner discharge openings 422, 422 is detachably bonded to the outer peripheral surface of the tubular member 42. A bond portion 820 of the sealing portion 82 constituting the seal member 8 is composed of two longitudinal bond portions 821 and 822, and two peripheral bond portions 823 and 824, as shown in FIG. 3. Of the two longitudinal bond portions 821 and 822 constituting the bond portion 820, one longitudinal bond portion 821 on the peel side that is situated on the action portion 84 side is formed so as to approach the other longitudinal bond portion 822 gradually from its opposite ends toward the longitudinal center thereof. That is, the longitudinal bond portion 821 on the peel side is constituted such that its peeling starts at its opposite ends, and proceeds gradually toward the longitudinal center thereof. In other words, the peripheral length between the two longitudinal bond portions 821 and 822 is larger at the opposite end parts than at the central part thereof. Thus, the toner discharge openings 422, 422 formed in the outer periphery of the tubular member 42, which are formed along the bond portion 820, ensure an opening area, and have larger peripheral lengths at the outer end parts thereof, reliably permitting the discharge of the toner. The bond portion 820 can be fused, or bonded with an adhesive, to the outer peripheral surface of the tubular member 42.

Figure 4:
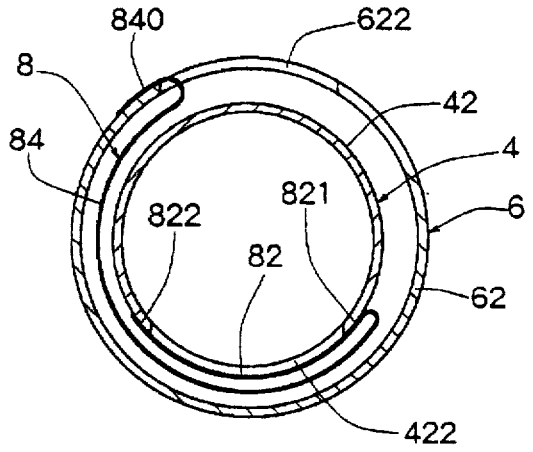
FIG. 4 is a cross sectional view of the toner cartridge illustrated in FIG. 1.

The action portion 84 defining the other end part of the seal member 8 is constructed as a connection to positions corresponding to the inside of the two peripheral bond portions 823 and 824 of the sealing portion 82, as shown in FIG. 3. This action portion 84, as shown in FIG. 4, is folded back at one side edge of the sealing portion 82, then extends over the sealing portion 82, and further extends clockwise in FIG. 4 along the outer peripheral surface of the tubular member 42 to pass through the toner passage opening 622 formed in the tubular member 62 constituting the outer tubular case 6. Then, a front end part of the action portion 84 is folded back along one side edge (left side edge in FIG. 4) of the toner passage opening 622, and further extends along the outer peripheral surface of the tubular member 62. The front end part of the action portion 84, i.e., bond portions 840, 840, is fused to the outer peripheral surface of the tubular member 62. The bond portions 840, 840 may be secured, using an adhesive, to the outer peripheral surface of the tubular member 62.

In the illustrated embodiment, the sealing portion 82 of the seal member 8 has two cut grooves 86 and 86 at its peel start side end part. As shown in FIG. 3, the cut grooves 86 and 86 are desirably provided inwardly of the peripheral bond portions 823 and 824, and at positions corresponding to, or outwardly of, the outer edge sides of the toner discharge openings 422 and 422. The cut grooves 86 and 86 are desirably formed at the bases on both sides of the action portion 84.

The toner cartridge 2 constructed in the foregoing manner is loaded with a toner in the following manner: After the toner cartridge 2 is assembled as in FIG. 2, the stopper 47 mounted to the toner fill port 466 formed in the end wall member 46 constituting the inner tubular container 4 is removed, and then a toner is loaded into the toner accommodation space 40 through the toner fill port 466. After the toner has been accommodated in the toner accommodation space 40 of the inner tubular container 4 constituting the toner cartridge 2, the stopper 47 is mounted to the toner fill port 466. The toner cartridge 2 thus filled with the toner is mounted on a developing device when it is put to use.

FIG. 1 schematically shows a developing device 10 on which the toner cartridge 2 is mounted. At an upper part of the developing device 10, a toner cartridge acceptance portion 102 is disposed. The toner cartridge acceptance portion 102 defines an acceptance space 106 extending substantially horizontally from an insertion opening 104 formed at one surface of the toner cartridge acceptance portion 102. The insertion opening 104 is a circular opening having an inner diameter corresponding to the outer diameter of the turning member 64 and the support member 66 that constitute the outer tubular case 6 of the toner cartridge 2. The cross sectional shape of the acceptance space 106 is circular in correspondence with the insertion opening 104. At a predetermined angular position at one surface part of the toner cartridge acceptance portion 102 where the insertion opening 104 is formed, there is formed a positioning groove 108 into which the registration projection 646 provided in the turning member 64 constituting the outer tubular case 6 is fitted. The toner cartridge acceptance portion 102 is also provided with a guide groove 110 for guiding the registration projection 646, the guide groove 110 being formed over an angle of 180 to 210 degrees as a continuum of the positioning groove 108 inwardly, by a predetermined amount, of the one surface where the insertion opening 104 is formed. Thus, after the toner cartridge 2 has been mounted in the toner cartridge acceptance portion 102, the outer tubular case 6 can be rotated over the angle of 180 to 210 degrees. At an end surface on the depth side of the toner cartridge acceptance portion 102, there are provided engagement members 112 which engage the rotation restraining members 465 formed so as to protrude from the other end wall member 46 constituting the inner tubular container 4.

The toner cartridge 2 in the illustrated embodiment is constructed as above, and its mounting on the developing device as well as its toner supply thereto will now be described.

The toner cartridge 2 is inserted into the toner cartridge acceptance portion 102 through the insertion opening 104 of the developing device 10, beginning with the other end wall member 46 side. On this occasion, the registration projection 646 provided in the turning member 64 constituting the outer tubular case 6 is aligned with the positioning groove 108 formed in the toner cartridge acceptance portion 102, whereby the toner cartridge 2 can be inserted to a predetermined position. Once the toner cartridge 2 is inserted to the predetermined position of the toner cartridge acceptance portion 102, the rotation restraining members 465 formed on the other end wall member 46 constituting the inner tubular container 4 engage the engagement members 112 provided on the depth-side end surface of the toner cartridge acceptance portion 102 to suppress the turning of the inner tubular container 4. The grip portion 645 provided at the turning member 64 constituting the outer tubular case 6 is positioned so as to protrude on the entrance side of the toner cartridge acceptance portion 102. At this moment, the toner discharge openings 422, 422 formed in the tubular member 42 constituting the inner tubular container 4 are positioned to face downwards, as shown in FIG. 4. Whereas the toner passage opening 622 formed in the tubular member 62 constituting the outer tubular case 6 is positioned to face upwards, as shown in FIG. 4.

Figure 5:
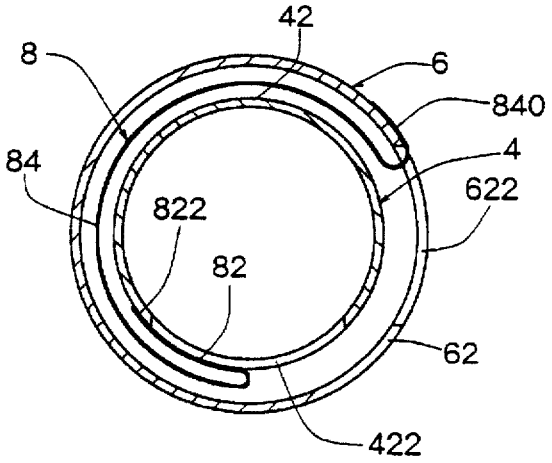
FIG. 5 is a cross sectional view similar to FIG. 4, showing a state in which an outer tubular case is turned through 90 degrees relative to an inner tubular container in the toner cartridge illustrated in FIG. 1.
Figure 6:
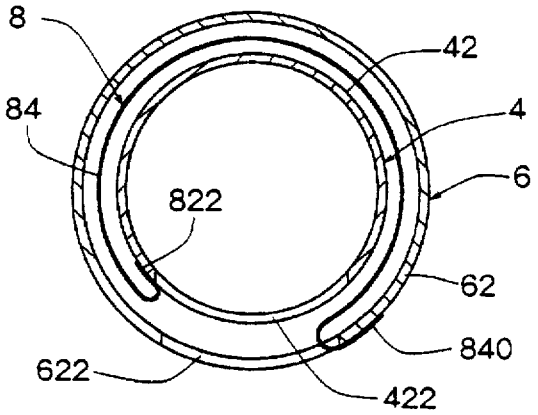
FIG. 6 is a cross sectional view similar to FIG. 4, showing a state in which an outer tubular case is turned through 180 degrees relative to the inner tubular container in the toner cartridge illustrated in FIG. 1.

After the toner cartridge 2 has been mounted in the toner cartridge acceptance portion 102 of the developing device 10 in the above-described manner, the grip portion 645 provided at the turning member 64 constituting the outer tubular case 6 is gripped to turn the outer tubular case 6 through 180 to 210 degrees clockwise in FIGS. 4 to 6, namely, until the registration projection 646 provided on the turning member 64 contacts the guide groove 110 formed in the toner cartridge acceptance portion 102. FIG. 5 shows a state in which the outer tubular case 6 is turned clockwise through 90 degrees from the state illustrated in FIG. 4, while FIG. 6 shows a state in which the outer tubular case 6 is turned clockwise through 180 degrees from the state illustrated in FIG. 4. The inner tubular container 4, as described previously, is restrained from turning, because the rotation restraining members 465 formed on the end wall member 46 are engaged with the engagement member 112 provided on the depth-side end surface of the toner cartridge acceptance portion 102. Thus, the inner tubular container 4 is kept in the state illustrated in FIG. 4. As will be seen from FIGS. 4 to 6, when the outer tubular case 6 is rotated with the inner tubular container 4 being restrained from turning, the action portion 84 of the seal member 8 is relatively pulled. Thus, the sealing portion 82 of the seal member 8 is successively peeled off the outer peripheral surface of the tubular member 42, beginning with the right side edge in FIG. 4. If the cut grooves 86, 86 were not formed in the seal member 8, the longitudinal bond portion 821 and peripheral opposite bond portions 823, 824 on the peel side would be gradually peeled off. In the illustrated embodiment, the seal member 8 has the cut grooves 86 and 86 inwardly of the peripheral opposite bond portions 823, 824. Thus, as the outer tubular case 6 turns, a pulling force acts on the action portion 84 of the seal member 8 to shear the seal member 8 from the cut grooves 86, 86 along the internal sides of the peripheral opposite bond portions 823,824. Consequently, the peel action on the bond portion 820 works only on the longitudinal bond portion 821 on the peel side. This means that upon completion of the peeling of the longitudinal bond portion 821, no peel load works any more. Hence, the peeling operation becomes easy, and a single operation is enough without the operating hand gripping the grip portion anew. In the illustrated embodiment, moreover, the cut grooves 86 and 86 are formed at the roots on both sides of the action portion 84. Thus, a shear force from the action portion 84 during the peeling can be made to directly act on the cut grooves 86 and 86, facilitating the cutting of the seal member 8. In the illustrated embodiment, furthermore, the longitudinal bond portion 821 on the peel side is adapted to start peeling at both ends, and gradually peel off toward the longitudinal center. Thus, load at the start of peeling can be decreased, and load during peeling can be rendered nearly constant.

When the outer tubular case 6 is turned to the state illustrated in FIG. 6 in the foregoing manner, the sealing portion 82 of the seal member 8 is peeled off and severed from the outer peripheral surface of the tubular member 42, with only the longitudinal bond portion 822 on the opposite side to the peel side being left intact. The toner discharge openings 422, 422 formed in the tubular member 42 constituting the inner tubular container 4 are unsealed. Simultaneously, the toner passage opening 622 formed in the tubular member 62 constituting the outer tubular case 6 is positioned to face downwards. As a result, the toner (not shown) accommodated in the inner tubular container 4 is dropped into the developing device 10 through the toner discharge openings 422, 422 and the toner passage opening 622. The cut grooves 86 and 86 formed in the sealing portion 82 of the seal member 8 are provided inwardly of the peripheral opposite bond portions 823 and 824, and at positions corresponding to, or outwardly of, the outer edge sides of the toner discharge openings 422 and 422. Hence, after the sealing portion 82 of the seal member 8 is severed, its cut edge sides are not exposed to the toner discharge openings 422 and 422. This makes the drop of the toner smooth.

In releasing the toner cartridge 2 from the developing device 10 after substantially all of the toner accommodated in the inner tubular container 4 is discharged, the operator grips the grip portion 645, and turns the outer tubular case 6 counterclockwise from the state of FIG. 6 to the state of FIG. 4. Thereby, the toner passage opening 622 formed in the tubular member 62 constituting the outer tubular case 6 is positioned to face upwards again. As a result, some toner remaining in the inner tubular container 4 and falling into the outer tubular case 6 through the toner discharge openings 422, 422 is reliably prevented from dispersing through the toner passage opening 622. With the outer tubular case 6 being returned to the position illustrated in FIG. 4, the toner cartridge 2 is pulled out of the toner cartridge acceptance portion 102 toward the operator.

While the present invention has been described based on the illustrated embodiments, it is to be understood that the invention is in no way limited thereto, but various changes and modifications may be made without departing from the spirit and scope of the invention. For example, the illustrated embodiments exemplify the structure in which the rotation of the inner tubular container 4 is restrained, while the outer tubular case 6 is turned. However, there may be adopted a structure in which the rotation of the outer tubular case 6 is restrained, while the inner tubular container 4 is turned.

In the toner cartridge of the present invention, the cut grooves are provided inwardly of the peripheral bond portions at the peel start side end parts of the sealing portion constituting the seal member. Thus, during peeling, the seal member is severed from the cut grooves along the internal sides of the peripheral opposite bond portions. Consequently, the peel action works only on the longitudinal bond portion on the peel side. This means that upon completion of the peeling of the longitudinal bond portion, no peel load works any more. Hence, the peeling operation becomes easy, and a single operation is enough without the operating hand gripping the grip portion anew.

In the toner cartridge of the invention, moreover, the sealing portion constituting the seal member has the longitudinal bond portions and peripheral bond portions defined around the toner discharge openings. The longitudinal bond portion on the action portion side that constitutes the seal member is adapted to start peeling at both ends, and gradually peel off toward the longitudinal center. Thus, load at the start of peeling can be decreased, and load during peeling can be rendered nearly constant. Since the longitudinal bond portion on the action portion side thus starts peeling at its opposite ends, and gradually peels off toward the longitudinal center thereof, the peripheral length between the two longitudinal bond portions is larger at the opposite end parts than at the central part thereof. Thus, the toner discharge openings, formed along the bond portions, ensure an opening area, and reliably permit the discharge of the toner at the outer end part.

What we claim is:

1. A toner cartridge comprising an inner tubular container having a longitudinally extending toner discharge opening and accommodating a toner; an outer tubular case having a toner passage opening corresponding to said toner discharge opening provided in said inner tubular container, and being fitted around said inner tubular container so as to be capable of relative rotation; and a seal member having a sealing portion for covering said toner discharge opening formed in said inner tubular container, said sealing portion being strippably bonded to the outer peripheral surface of said inner tubular container, and an action portion formed as a continuum of said sealing portion and having a front end part secured to said outer tubular case; wherein said sealing portion of said seal member has a longitudinal bond portion and a peripheral bond portion defined along the surroundings of said toner discharge opening, and a cut groove provided inwardly of said peripheral bond portion at the peel start side end part thereof.

2. A toner cartridge comprising an inner tubular container having a longitudinally extending toner discharge opening and accommodating a toner; an outer tubular case having a toner passage opening corresponding to said toner discharge opening provided in said inner tubular container, and being fitted around said inner tubular container so as to be capable of relative rotation; and a seal member having a sealing portion for covering said toner discharge opening formed in said inner tubular container, said sealing portion being strippably bonded to the outer peripheral surface of said inner tubular container, and an action portion formed as a continuum of said sealing portion and having a front end part secured to said outer tubular case; wherein said sealing portion of said seal member has a longitudinal bond portion and a peripheral bond portion defined along the surroundings of said toner discharge opening, and said longitudinal bond portion on the action portion side is peeled off, beginning at the opposite ends thereof, gradually toward the center thereof in the longitudinal direction.

* * * * *